United States Patent [19]

von der Eltz et al.

[11] 4,135,268

[45] Jan. 23, 1979

[54] PROCESS FOR THE UNIFORM DYEING OF TEXTILE WOUND PACKAGES OR PACKAGED MATERIAL

[75] Inventors: Hans-Ulrich von der Eltz, Frankfurt am Main; Siegfried Glander, Bad Soden am Taunus, both of Fed. Rep. of Germany

[73] Assignee: Hoechst Aktiengesellschaft, Frankfurt am Main, Fed. Rep. of Germany

[21] Appl. No.: 859,532

[22] Filed: Dec. 12, 1977

[30] Foreign Application Priority Data

Dec. 14, 1976 [DE] Fed. Rep. of Germany ..... 2656527

[51] Int. Cl.[2] ..... D06B 5/16

[52] U.S. Cl. ..... 8/155.1; 8/154; 8/155.2; 8/158

[58] Field of Search ..... 8/DIG. 16, 150, 154, 8/155.1, 155.2, 155, 158; 118/8; 427/8; 68/12 R, 13 R, 184, 187, 189; 364/470, 510

[56] References Cited

FOREIGN PATENT DOCUMENTS 2531442 10/1976 Fed. Rep. of Germany ..... 8/158

*Primary Examiner*—Philip R. Coe

*Attorney, Agent, or Firm*—Curtis, Morris & Safford

[57] ABSTRACT

Process for creating uniform flow conditions for circulating liquors flowing through textile wound packages or packaged material of synthetic and/or natural fibers in the course of machine dyeing by the exhaustion method under elevated pressure, wherein the zones of liquor flow which deviate from a mean value are determined across the entire block of material by measuring the differential pressures within the wound packages of material at several pairs of positions, whereupon the localized flow differences are equalized in all positions of the block of material by altering the properties and structures of the packages of material, by modifying the dyeing program, by varying the pumping power, by design changes in the dyeing machine and/or special selection and optimum metering of auxiliaries.

9 Claims, No Drawings

PROCESS FOR THE UNIFORM DYEING OF TEXTILE WOUND PACKAGES OR PACKAGED MATERIAL

The dyeing of textile material in the form of wound packages or in a packaged system in dyeing machines with circulating liquors by an exhaustion process under elevated pressure has been known for a long time. If difficulties arise with respect to the levelness of such dyeings, attempts are made, above all, to delay the exhaustion of the dyes so that useful tinctorial results are obtained.

It is likewise known, however, that a uniform and adequate flow of liquor through the wound packages of material is a necessary prerequisite for level dyeing. In most cases, however, only the total flow-through of liquor in a given dyeing machine has been determined. This total flow-through essentially depends on the design details of the machine, for example the pumping power, the lines and valves, and the flow resistance of the material being dyed in conjunction with the properties of the liquor, such as, for example, temperature, viscosity and surface tension. The total flow-through is expressed in liters per kg times minute (1/kg.min) and this is determined by measuring the differential pressure at the intake before and after the discharge sides of the pump (in the direction of flow). However, these data give no information about the actual flow conditions in various regions of the wound packages. In this respect, the simplifying assumption is made that the liquor flow within the individual wound packages is uniform in different positions, but this is by no means true.

Particular problems, in connection with the state of affairs discussed above, arise above all in rapid-dyeing machines which are expected to gain increasing acceptance in future. It is precisely in this case that non-uniform flows of the circulating liquor produce unlevel dyeings which can only be corrected with loss of time.

It is the object of the present invention to design a process for creating uniform flow conditions for circulating liquors flowing through textile wound packages or packaged material of synthetic and/or natural fibers in the course of machine dyeing by the exhaustion method under elevated pressure, wherein the difficulties with respect to levelness and penetration, which are caused by a non-uniform flow through the packages of material, are overcome so that the levelness of such dyeings is substantially increased or even made possible in the first place.

This object is achieved when the zones of liquor flow which deviate from a mean value are determined across the entire block of material by measuring the differential pressures within the wound packages of material at several pairs of positions, whereupon the localized flow differences are equalized in all positions of the block of material, that is to say the wound package, the spool column, the packaged block of material or the wound package of piece goods on the dyeing beam, by altering the properties and structures (for example density, type of wound package), caused by the geometry, of the wound packages of material, by modifying the dyeing program, by varying the pumping power, by design changes in the dyeing machine and/or by special selection and optimum metering of auxiliaries, so that uniform flow conditions which are a necessary prerequisite for level dyeing of these textile articles are achieved in all positions of the wound package of material.

According to the present invention, the results to be achieved will be the more useful, the more pairs of measuring positions are present on the dyeing machine (of the customary type) employed. To carry out the measurements of the differential pressures, cannulae are placed in the wound package of material in several positions and the pressures are tapped off outside the dyeing machine, via heat-resistant tubing through a flange.

The measuring array used for determining the flow conditions in the textile wound packages consists of known electronic instruments or components. The combination of these instruments and components has, however, hitherto not been used for determining the pressure conditions, and hence the flow conditions, within textile wound packages. According to the process, a mixed static/dynamic differential pressure is measured at the pairs of measuring points so that information about the change in total flow-through can be gained on the basis of the relative differences of the flows in different regions of the wound packages. For this purpose, measuring cannulae with eyelets are introduced into the wound packages in at least two measuring positions (each associated in pairs) and taken outside to the measuring apparatus via lines (through a pressure-tight fitting in the wall of the dyeing machine). A differential pressure receiver is connected to this pair of pressure lines. In these (known) pressure receivers, a membrane transmits the pressure changes to an extensible wire element. The extensible wires are electrically interconnected in a Wheatstone bridge so that the pressure is converted into a change of resistance.

A carrier frequency-measuring amplifier is used for supplying the bridge in order to rectify and amplify the output signal. The output voltage is proportional to the pressure to be measured and is registered on a compensating recorder or, in the case of several pairs of measuring points for the differential pressure, on a multi-point printer.

It is self-evident that, within the scope of the process claimed, the measurements and the measures for influencing the non-uniformities of the liquor flow are effected in accordance with the output capacity of the given dyeing machine. Using the measured results as a basis, this is accomplished by varying the factors which are involved in creating the differences in flow-through within the wound packages of material. Thus, in the case of measurements in yarn-dyeing machines on wound packages of yarn, muffs or spools with or without dyeing tubes of perforated material in the form of conical or cylindrical shells, the equalization of ascertained local differences in flow to give optimum flow conditions which are uniform everywhere throughout the entire block of material, is effected by varying the ratio of internal to external diameter, the layer thickness, the density of the wound package, the height of the column and the shape of the wound packages. In the case of measurements which have been obtained in the block of material of package-dyeing machines (for yarns or loose material), such an equalization is effected by altering the pressing force or the height of the block of material.

If corresponding measurements have been carried out on the wound package of piece goods in beam-dyeing machines, the equalization in question is accomplished by varying the layer thickness and the beam diameter and by covering the perforation at the edges of the material. In addition to the above measures to eliminate non-uniformities of the liquor flow, which amount to changes in the structure of the wound package of material, an influence on the total flow of circulating liquor, modification of the individual program steps of the dyeing process, minor changes in the design of the dyeing machine used and certain depositions of auxiliaries, if these are employed, such as anti-foaming agents, wetting agents and levelling agents, are also possible for the said purpose — as already mentioned above. Taking these requirements into account, dyeings which would hitherto have been unlevel are now obtained firstly level and secondly in a shorter dyeing time.

The examples which follow are intended to illustrate the functional principle of the process claimed.

EXAMPLE 1

The following investigation relates to the determination of the relative flow differences in two regions of a wound package:

With a total flow of 21,300 l/min, a differential pressure of 100 mbars was measured on the edges of a wound package in a 450 kg beam-dyeing machine and a differential pressure of 180 mbars was measured in the center. To equalize the flow difference, the total flow had to be throttled to 15,000 l/minute in order to reach the value of 100 mbars in the center. It follows from this result that, with a total flow of 21,300 l/minute, only 70% of the amount of liquor was flowing at the edges of the wound package, as compared with the center of the wound package. It was possible to achieve a flow-through of 97% at the edges by a change in the covering of the perforation.

EXAMPLE 2

Ray-like, light-colored regions in the upper muffs were discovered after dyeing in a 150 kg yarn-dyeing machine. Thereupon the differential pressures in the upper, central and lower muffs were measured and it was found that, in the initial phase of the dyeing process, not enough liquor was flowing through the upper muffs, due to inclusions of air, as compared with the lower and central regions. By altering the dyeing program, that is to say by including an additional deaeration phase in the program, level dyeings were achieved.

EXAMPLE 3

As the result of analogous flow measurements, it was found in a yarn-dyeing machine as in Example 2 that the flow differences can be reduced to a minimum by altering the pumping power and that level dyeings can be achieved.

EXAMPLE 4

The measured results of the differential pressures in the wound packages can, at the same time, also be evaluated for discovering defects caused by the machine. Thus, in a 450 kg beam-dyeing machine, it was found with the aid of the flow measurements that, first, a totally different covering of the perforation of the beam is necessary (2 cm) than had hitherto been set empirically (15 cm) and that this covering must automatically be changed as the wound package slides about or shrinks. The problem of the edges of the wound package being dyed too lightly was thus eliminated and a large saving in dyeing time was obtained simultaneously. Furthermore, the process according to the invention can indicate more extensive changes to a given dyeing machine.

EXAMPLE 5

In pursuing the desired aim of achieving more uniform flows through various points in the wound packages with the aid of the measurements of the differential pressure, it was found in a 350 kg yarn-dyeing machine that a different packing density is necessary for semi-stretched and fully stretched fibers. Furthermore, it also proved to be advantageous for the flow conditions to use different tubes, on which the fibers are wound, for different types of machine and for different types of fiber.

EXAMPLE 6

In cheese dyeing machines, it was found as the result of measurements of the differential pressures in several regions of a spool that the usual conical shape of the wound package creates less favorable flow conditions than a cylindrical shape. Thus, shapes of the wound package can be found which are the optimum for achieving a level dyeing.

EXAMPLE 7

The use of the process is also an aid in determining the selection of the correct auxiliaries and the amount thereof. The measurements of the differential pressures in muffs showed which amount of a certain anti-foaming agent must be employed in order to achieve the most rapid equalization of the flows in the wound packages. The destruction of the foam is associated with a reduction of the flow resistance.

What is claimed is:

1. A process for creating uniform flow conditions for circulating liquors flowing through textile wound packages or packaged material of synthetic and/or natural fibers in the course of machine dyeing by the exhaustion method under elevated pressure, wherein the zones of liquor flow which deviate from a mean value are determined across the entire block of material by measuring the differential pressures within the wound packages of material at several pairs of positions, whereupon the localized flow differences are equalized in all positions of the block of material by altering the properties and structures of the packages of material, by modifying the dyeing program, by varying the pumping power, by design changes in the dyeing machine and/or by special selection and optimum metering of auxiliaries.

2. A process as claimed in claim 1, wherein cannulae for measuring the differential pressures are placed in the wound package of material in several positions and the pressures are tapped off outside the dyeing machine, via heat-resistant tubing through a flange.

3. A process as claimed in claim 2, wherein differential pressure receivers are used for measuring the static-dynamic differential pressures.

4. A process as claimed in claim 1, wherein the measurements and the equalizing measures for influencing the non-uniformities of the liquor flow are effected in accordance with the output capacity of the given dyeing machine.

5. A process as claimed in claim 1, wherein the measurements are carried out in yarn-dyeing machines on wound packages of yarn, muffs or spools with or without dyeing tubes of perforated material in the form of conical or cylindrical shells, and the equalization of ascertained local differences in flow to give optimum flow conditions which are everywhere uniform throughout the entire block of material, is effected by varying the ratio of internal to external diameter, the layer thickness, the density of the wound package, the height of the columns and the shape of the wound packages.

6. A process as claimed in claim 1, wherein the measurements are carried out in the block of material of package-dyeing machines (for yarns or loose material) and the equalization of locally ascertained differences in flow to give optimum flow conditions which are everywhere uniform throughout the entire block of material is effected by altering the pressing force or the height of the block of material.

7. A process as claimed in claim 1, wherein the measurements are carried out on the wound package of piece goods in beamdyeing machines and the equalization of locally ascertained differences in flow to give optimum flow conditions which are everywhere uniform throughout the entire block of material, is effected by varying the layer thickness and the beam diameter and by covering the perforation at the edges of the material.

8. A process for creating uniform flow conditions for circulating liquors flowing through a textile material in a form of a wound or layered package while machine dyeing the same by the exhaustion method under elevated pressure, by means of measuring the differential pressure of the liquor which is fed to said textile material and that liquor which is discharged from said material, while controlling the liquor flow by altering a make-up and/or a dimension of the packages of material, while modifying the liquor application program, and while varying the total amount of the liquor flow through, which comprises measuring differential pressures of the circulating liquor within the wound packages of material at several pairs of measuring points distributed over different positions with regard to the height or length of the package and determining there the zones or liquor flow which deviate from each other across the entire block of material, whereupon localized differences within the liquor flow are equalized in all positions of the block of material by altering the above-defined parameters in response to the ascertained measuring values.

9. A process of testing for and controlling uniformity of liquor application to textile material in the form of a wound or layered package, which comprises applying a liquor by an exhaust method, under pressure, to a textile material in the form of a wound or layered package, which package has within it several pairs of measuring means, each measuring means being capable of measuring the differential pressure of liquor flow in its vicinity and each of a pair of measuring means being located at a different position with regard to the height or length of the package, measuring the differential pressure of liquor flow in the vicinity of each measuring means, and, if necessary, adjusting the liquor flow through one or more parts of the package or a subsequent package to eliminate measured, localized flow differences.

* * * * *